United States Patent [19]

de Vries et al.

[11] Patent Number: 4,727,582

[45] Date of Patent: Feb. 23, 1988

[54] HEARING AID WITH ADJUSTABLE FLEXIBLE CONNECTION MEMBER

[75] Inventors: Robert de Vries; Roelof A. Venema; Johannes P. T. Damen, all of Eindhoven, Netherlands

[73] Assignee: U.S. Philips Corporation, New York, N.Y.

[21] Appl. No.: 712,577

[22] Filed: Mar. 15, 1985

[30] Foreign Application Priority Data

Mar. 23, 1984 [NL] Netherlands ..... 8400925

[51] Int. Cl.[4] ..... H04R 25/00; H04R 1/02

[52] U.S. Cl. ..... 381/68.7; 381/187; 381/188; 381/205

[58] Field of Search ..... 179/107 H, 107 R; 181/129; 381/69, 68.7, 68, 169, 182, 187, 188, 205

[56] References Cited

U.S. PATENT DOCUMENTS 4,291,203 9/1981 Bellafiore ..... 381/68.6

FOREIGN PATENT DOCUMENTS 2039191 7/1980 United Kingdom ..... 179/107 H

*Primary Examiner*—Jin F. Ng

*Assistant Examiner*—Danita R. Byrd

*Attorney, Agent, or Firm*—Robert T. Mayer; Bernard Franzblau

[57] ABSTRACT

A hearing aid, in particular a behind-the-ear hearing aid, comprising a first unit (1) that includes an amplifier (4), a hook (3) formed with a duct (16) and a space (8). A second unit (2) includes an electro-acoustic transducer (12). The second unit is intended to be worn in the ear. A tubular element (15) for the mechanical connection of the two units accommodates connecting means (14) for electrically coupling the transducer (12) to the amplifier (4). The element (15) is axially slidable inside the duct. This enables the hearing aid to be adapted to the size of the ear of the person wearing the hearing aid. The connecting means (14) is long enough so that even for a big ear, the electrical connection is still intact or can be made. When the hearing aid is adapted to a smaller ear, the connecting means (14) is then too long but the space (8) takes up the excess length of the connecting means.

22 Claims, 7 Drawing Figures

HEARING AID WITH ADJUSTABLE FLEXIBLE CONNECTION MEMBER

BACKGROUND OF THE INVENTION

This invention relates to a hearing aid, in particular a behind-the-ear hearing aid, comprising;

a first unit comprising an amplifier, a second unit including an electro-acoustic transducer, and intended to be worn in the ear, first connecting means enabling the electroacoustic transducer to be coupled electrically to the amplifier, and second connecting means enabling the two units to be inter-coupled mechanically. The second connecting means comprise a tubular element having a first end coupled to one unit, which element accommodates the first connecting means.

Such a hearing aid is disclosed in British Patent Specification No. 792,742 and U.S. Pat. No. 4,291,203. British Patent Specification No. 792,742 describes a behind-the-ear hearing aid in which the first unit is intended to be worn behind the ear and which, in addition to the amplifier, comprises a microphone and a battery. The electro-acoustic transducer in the second unit is the loudspeaker (also referred to as an earphone.) The first connecting means provide an electrical coupling between an output of the amplifier in the first unit and the loudspeaker in the second unit. U.S. Pat. No. 4,291,203 describes a hearing aid in which the first unit is intended either to be worn behind the ear or to be incorporated in a spectacles frame. In addition to the amplifier, the first unit comprises a loudspeaker and a battery. The electro-acoustic transducer in the second unit is the microphone. Thus, the first connecting means establish an electrical coupling between the microphone and an input of the amplifier.

It has been common practice to design the first and the second connecting means as to the length and shape thereof so that they match the shape of the ear. As a result, they are less conspicuous, see for example the above-mentioned British Patent Specification No. 792,742.

This tailoring of the first and the second connecting means, which has to be done by the hearing aid retailer or by an audiologist, is an intricate and time consuming job in the case of the hearing aids described in the above-mentioned publications.

SUMMARY OF THE INVENTION

The invention aims at providing a hearing aid which enables this tailoring of the connecting means to be effected in a very simple manner. According to the invention the hearing aid is characterized in that a part of the other unit has a duct of a diameter larger than the outer diameter of the tubular element, so that, in a condition in which the tubular element is not secured relative to said part of the other unit, said tubular element is slidable in said duct over at least a part of its length and in the longitudinal direction of said duct, and in a condition in which the tubular element is secured relative to said part of the other unit, said tubular element extends in the duct over at least a part of its length. The first connecting means has a minimum length such that, viewed from the other unit, when the tubular element in the duct of said part has been slid out of said duct to the maximum permissible extent, the electrical coupling is still intact or can be made, and at least one of the two units has a space for taking up the excess length of the first connecting means when the tubular element has been slid further into the duct in said part. An advantage of this construction is that the manufacturer of the hearing aid can supply the complete aid to the retailer or audiologist, even in such a way that the electrical coupling of the first connecting means to the amplifier and to the electroacoustic transducer may have been made already. In fact, only the second connecting means have to be adapted. For this purpose the tubular element is slidable in said part of the other unit. The retailer or audiologist can now vary the distance between the two units and hence adapt the second connecting means exactly to the shape of the ear (i.e. the length of the portion of said means which project from the duct viewed from said other part) by simply sliding the tubular element further into or out of the duct in said part of the other unit. Once the correct length has been found the tubular element may be secured in the duct, for example by means of an adhesive or by clamping, for example by means of a clamping nut. It is obvious that other means may be employed for securing the tubular element.

The phrase "when the tubular element has been slid out of said duct to the maximum permissible extent" is to be understood to mean either that position of the tubular element in the duct in which, viewed from the other unit, it has been slid out of the duct as far as possible while still allowing it to be secured in the duct, or that position of the tubular element in the duct in which the first connecting means do not allow the element to be slid out any further because otherwise the electrical coupling would not remain intact or could no longer be made.

Evidently, the length of the first connecting means should be such that even if the hearing aid (in particular the second connecting means) has to be adapted to a big ear, so that the length of the part of the second connecting means which projects from the duct must be large, the electrical coupling remains intact or can still be made. In the case of adaptation to a smaller ear the length of the first connecting means will be too large. By sliding the tubular element futher into the duct during adaptation this excess length is automatically slid into the relevant space. Thus, it is no longer necessary to cut a part to size. The correct length can be determined simply by sliding the tubular element into the duct, after which the tubular element may be secured, so that the hearing aid can be adapted in a very simple and rapid manner.

Another advantage can be obtained in that, if the tubular element is made of a flexible material, the hearing aid can be adapted very simply and rapidly to the left ear or the right ear. Thus, if a possible ear piece containing the second unit, is disregarded, no specific parts for a specific ear are required. The hearing aid can always be adapted to a left or right ear by rotating the tubular element about its longitudinal axis before it is fixed in the duct.

A further advantage is that the tubular element may provide pull-relief. The second unit (which is to be worn in the ear) may be removed from the ear by pulling at the first unit. Via the second connecting means (the tubular element) the pulling force is transmitted to the second unit so that it can be pulled out of the ear without a tensile force being exerted on the first connecting means (the electrical wiring). The tubular element thus provides stress relief for the first connecting means.

It is to be noted that the adaptation of the length of the second connecting means to the ear has also been described in German Offenlegungsschrift No. 27.21.469. The method of adapting this length described therein differs completely from that described above. When the method described in said German Offenlegungsschrift is used the correct length is obtained by cutting a lead provided with two conductive foils and subsequently making both the mechanical and the electrical connections by means of a special clamping contact. Such a method is more intricate and expensive.

In a hearing aid in accordance with the invention the space for taking up the excess length of the first connecting means is preferably provided with a spindle around which the first connecting means have been wound at least once. This can ensure that during insertion of the tubular element into the duct the excess length of the first connecting means can be taken up more readily in said space. Taking up the excess length can be facilitated even further by arranging a spiral spring on the spindle, securing one end of the spiral spring to a fixed part of the unit in which the space is formed, and securing the other end to the first connecting means. When the tubular element has been inserted into the duct to the maximum extent it can be arranged that the spiral spring is wound up fully.

Since the second unit is intended to be worn in the ear, this unit generally has a small volume. The first unit generally has a larger volume, which means that said space is preferably formed in the first unit. However, it is also possible to provide both units with a space, each space taking up a part of the excess length of the first connecting means.

A hearing aid in accordance with the invention in the form of a behind-the-ear hearing aid, in which the first unit is banana shaped and is intended to be worn behind the ear, for which purpose it comprises a hook, may be further characterized in that the first unit is said other unit and that said part of the other unit is the hook of the behind-the-ear hearing aid. The said part (the hook) is also tubular and is curved in the longitudinal direction so as to be hooked over the connection between the ear lobe and the head.

In the foregoing it has been stated that a hearing aid manufacturer may deliver a hearing aid in accordance with the invention to an audiologist or a hearing aid retailer in a condition in which the tubular element has not yet been secured in the duct, but in which the electrical connection has always been made with the aid of the first connecting means has. In that case the audiologist or retailer cannot choose a different combination of a specific first and a specific second unit without severing the electrical connection. In order to give the audiologist or retailer a choice in the selection of a desired combination of a specific first and a specific second unit, the manufacture may supply separate first and second units which contain the first connecting means but which have not yet been interconnected electrically. In practice the manufacturer then supplies a unit, preferably the first unit, which has a space for taking up the excess length of the first connecting means and a unit, preferably the second unit, to which one end of the tubular element and one end of the first connecting means have already been coupled, the first connecting means extending at least partly inside the tubular element. The desired first and second units may then be coupled electrically to each other by the audiologist or retailer, after which the hearing aid can be adapted in the manner described in the foregoing.

DESCRIPTION OF THE DRAWING

The invention will now be described in more detail, by way of example, with reference to the drawings, in which identical reference numerals in different Figures relate to identical elements. In the drawings.

DESCRIPTION OF THE INVENTION

Figure 1:
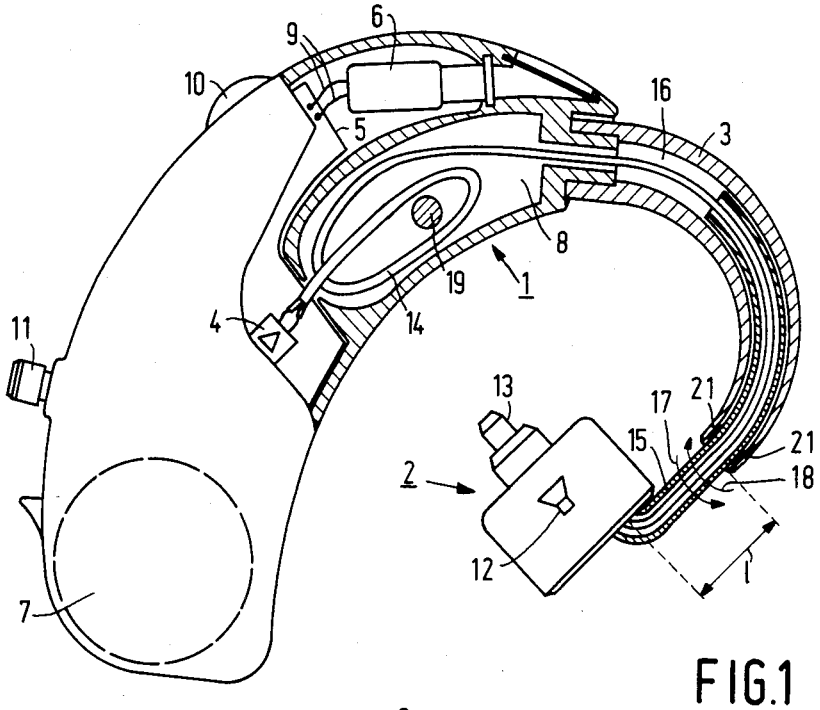
FIGS. 1 to 3 show a first embodiment.

FIG. 1 shows an embodiment of the invention in the form of a behind-the-ear hearing aid comprising a first unit 1 intended to be worn behind the ear and a second unit 2 intended to be worn in the ear. FIG. 1 is a side view and partly a sectional view of the first unit 1. The first unit 1 is banana shaped and has a hook 3 with which unit 1 is hooked behind the ear. The unit 1 comprises an amplifier represented schematically by the element bearing the reference numeral 4. The which amplifier is accommodated on a p.c. board 5 in unit 1, which also houses a microphone 6, a battery 7 and a space 8. By means of the electrical wires 9 the microphone 6 is electrically coupled to the p.c. board 5 and thus to an input of the amplifier 4 on the p.c. board. The first unit further comprises a volume control 10 and an on/off switch 11. The second unit 2, which is shown in elevation, comprises an electroacoustic transducer in the form of a loudspeaker (or earphone). The earphone is only shown schematically, see the reference numeral 12. The part referenced 13 is the outlet aperture for the sound produced by the earphone 12. The unit 2 must be incorporated either in a special earpiece (not shown) whose shape matches the shape of the earshell of the person wearing the hearing aid or in a standard earpiece.

The hearing aid further comprises first connecting means 14 enabling the output of the amplifier 4 to be coupled electrically to the earphone 12 and second connecting means 15 enabling the two units 1 and 2 to be intercoupled mechanically. The second connecting means 15, shown in sectional view, is constructed as a tubular element inside of which the first connecting means 14 are arranged.

Figure 2:
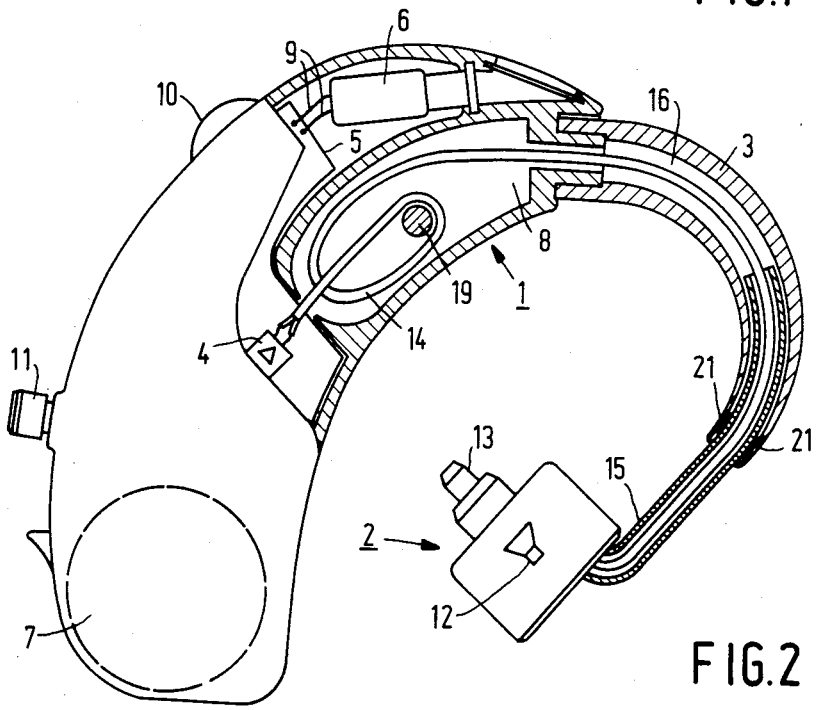
Figure 3:
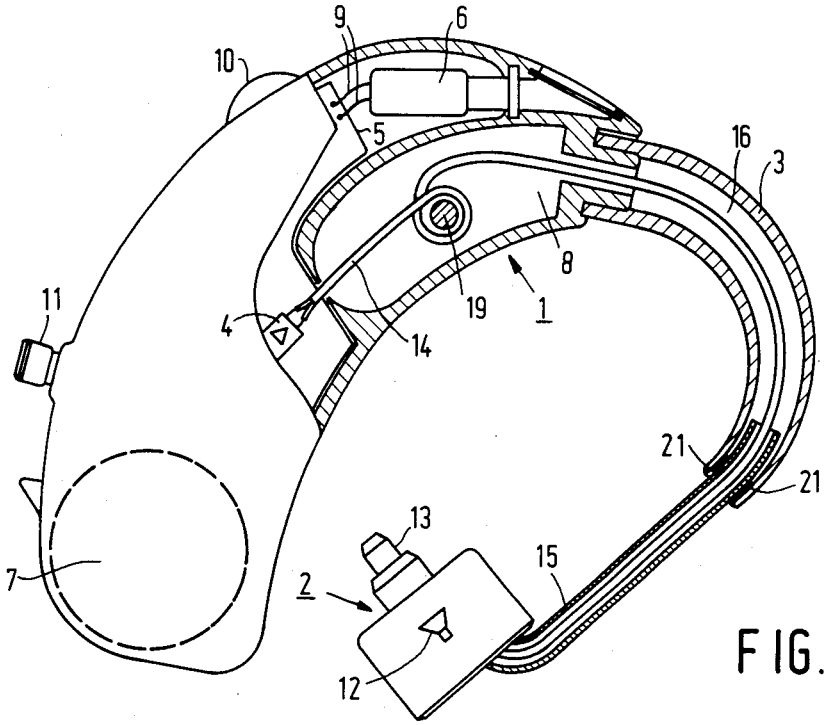

A part of the first unit 1, namely the hook 3, is formed with a duct 16 of a diameter which is larger than the outer diameter of the tubular element 15 so that the tubular element, when it is not fixed relative to the hook 3, is slidable inside the duct 16 over at least a part of its length and in the longitudinal direction of said duct. FIG. 1 shows the hearing aid in which the tubular element 15 has been inserted into the duct 16 for the greater part. FIG. 2 shows the same hearing aid, but now approximately half the length of the tubular element 15 projects from the duct. FIG. 3 also shows the same hearing aid but now the tubular element 15 has been slid out of the duct 16 over the greater part of its length.

This slidability of the tubular element 15 in the duct 16 is necessary in order to adapt the hearing aid, and in particular the length l (see FIG. 1) between the end of the hook 3 and the second unit 2, or the effective length of the tubular element 15, to the size of the ear of the user of the hearing aid. The far inserted position of FIG. 1 is intended for adaptation to a small ear and the far extended position of FIG. 3 is intended for adaptation to a big ear. The hearing aid shown in FIG. 2 has been adjusted to an ear of average size.

It will be appreciated that in the present case, in which the tubular element 15 is slidable inside the curved hook 3, the tubular element 15 should be made of a flexible material. This also has the advantage that the hearing aid shown in FIG. 1 may be used both for a left ear and for a right ear. This adaptation can be obtained by rotating the tubular element 15 about its longitudinal axis as indicated by the arrows 17 and 18 in FIG. 1. By rotating the tubular element 15 (as indicated by the arrow 17) through 90° so that the second unit 2 has moved forward out of the plane of the drawing, a hearing aid for a left ear is obtained. By rotating the tubular element 15 (as indicated by the arrow 18) through 90° so that the second unit 2 is rotated backward out of the plane of the drawing, a hearing aid is obtained which can be worn behind the right ear.

Obviously, the length of the first connecting means (the electrical wiring) 14 should be long enough to establish the electrical coupling between the amplifier 4 and the earphone 12, even when the hearing aid is adapted to a big ear (FIG. 3). This means that in the case of adaptation of the hearing aid to a smaller ear (FIGS. 1 and 2) the first connecting means 14 will be too long. The above-mentioned space 8 has been formed in the unit 1 in order to take up the excess length of the first connecting means 14 when the tubular element 15 is in the position in which it has been slid further into the duct 16. This is clearly visible in FIGS. 1 and 2. By inserting the tubular element 15 further into the duct 16 the excess length of the electrical wiring 14 is slid into the space 8.

In order to facilitate this insertion of the wiring 14 into the space 8 the space is preferably provided with a spindle 19 around which the wiring 14 is wound at least once. Without this spindle the wiring 14 would be pulled taut, i.e. into a straight line, in the space 8 when the tubular element 15 is pulled out of the duct 16 as far as possible. When the element is subsequently slid inwards this might give rise to problems because the electrical wiring 14 will not bend easily, which is necessary if the excess length is to be taken up in the space 8. By winding the wiring 14 at least once around the spindle 19 the wiring 14 will already have a curved portion even if the element 15 has been slid out as far as possible (FIG. 3), so that taking up the excess length is now much easier.

Figure 4:
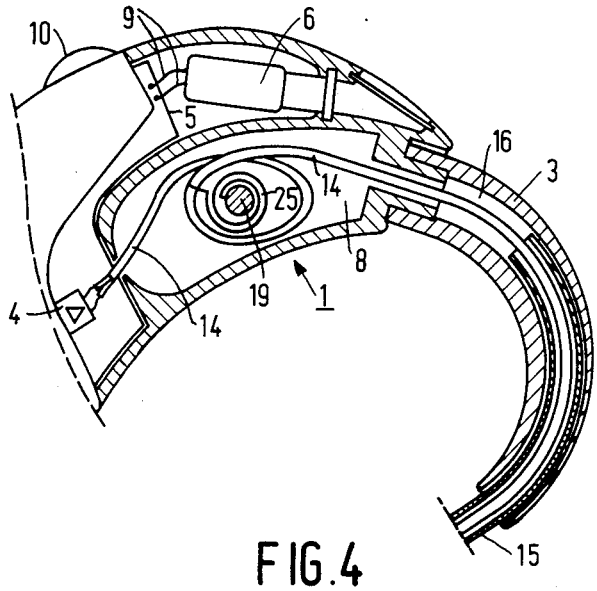
FIG. 4 shows part of a second embodiment of the invention.

Accommodating the excess length in the space 8 can be further improved (see FIG. 4) by arranging a spiral spring 25 on the spindle 19, one end of the spring being secured to the spindle or elsewhere to the housing in which the space 8 is formed, and the other end to the first connecting means. FIG. 4 shows the tubular element 15 in the far inserted position in the duct 16. The spiral spring 25 is then wound up (almost) fully. By pulling the element 15 further outwards the spiral spring 25 is expanded so that it is further tensioned and exerts an inwardly directed force (into the space 8) on the electrical wiring 14, which further facilitates taking up the wiring 14 when the element 15 is again slid into the duct 16.

Another step which may be applied to the hearing aid shown in FIG. 1, with or without spindle 19, is to lead the wiring 14 from the connection to the p.c. board 5 to that side of the space where the duct 16 terminates into the said space and to connect the wiring at this location to a fixed position in the said space. In this way a similar loop is formed in the wiring as shown in FIG. 1.

After the hearing aid has been adapted (by shifting the element 15 inside the duct 16), the element 15 must be secured in the hook 3. In FIGS. 1 to 3 this is effected by means of an adhesive 21.

Figure 5:
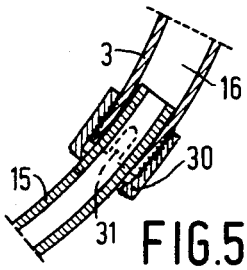
FIG. 5 shows a different attachment of the tubular element with the hook used in the embodiments shown in FIGS. 1 to 4.

FIG. 5 illustrates a different method of securing the tubular element 15 in the hook 3. FIG. 5 shows only a part of the two elements. Moreover, the wiring 14 is not shown for the sake of clarity. The construction comprises a clamping nut 30 with an internal screwthread. The end portion of the hook 3 is formed with a slit 31. Thus, when the nut 30 is tightened the hook 3 is compressed, thereby clamping the tubular element 15 inside the duct 16.

It will be appreciated that other methods of securing are also possible.

Figure 6:
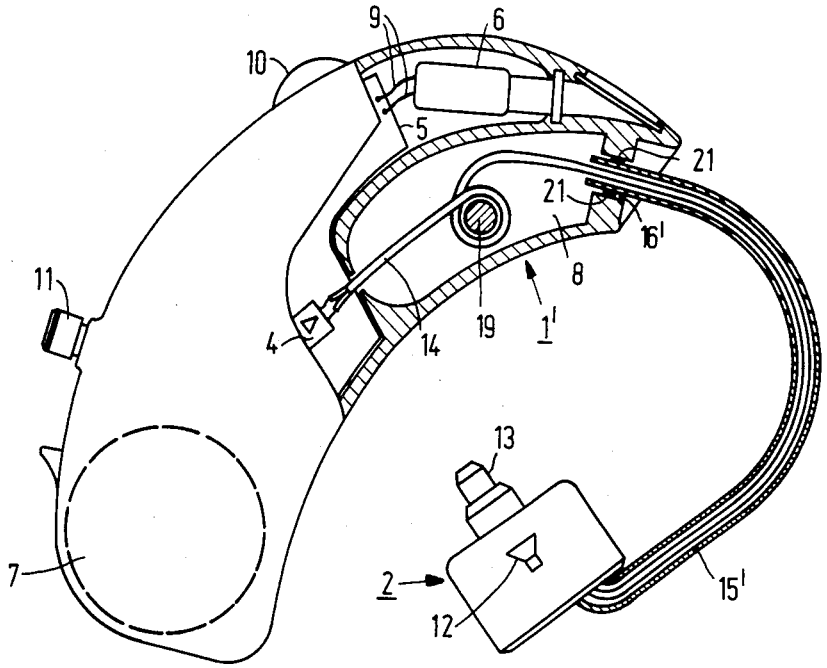
FIG. 6 shows another embodiment of the invention.

Another embodiment of the invention is shown in FIG. 6. The difference with respect to the embodiment shown in FIGS. 1 to 3 resides in that part of the first unit 1' which contains the duct 16'. This duct 16' is short and simply comprises a hole in the housing of the first unit 1'. The tubular element 15' is longer and now terminates in the space 8. FIG. 6 shows a hearing aid in which the tubular element 15' has been slid out to the maximum extent. In the case of adaptation to a smaller ear, the tubular element 15' should be slid further into the duct 16', i.e. further into the space 8. The tubular element 15' is again secured inside the duct 16' by means of an adhesive 21.

Figure 7:
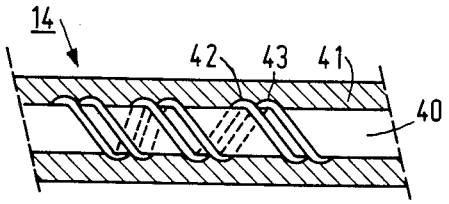
FIG. 7 shows an example of the first connecting means.

FIG. 7 shows an example of the first connecting means 14 which may be used in the hearing aid in accordance with the invention. The connecting means 14 may be constructed as a core 40, of, for example, a plastic material (nylon) around which the electrical conductors 42 and 43 have been wound. This assembly is accommodated in a sleeve 41. Only the sleeve 41 is shown in cross-section. The core 40 and the conductors 42 and 43 are shown in side view. Depending on the type of electroacoustic transducer in the second unit 2, three conductors could be arranged around the core. If the second unit 2 accommodates both the microphone and the earphone, even four or five conductors may be wound around the core 40.

These first connecting means have the advantage that they are inherently stress relieved, namely by means of the core 40. The ends of the core are then mechanically secured in the first and the second unit. If the user of the hearing aid now grips the tubular element 15 or 15' with the fingers in order to pull the second unit 2 out of the ear, the first connecting means 14 will be clamped in the element 15 or 15' by compressing this element. Since the conductors 42, 43 have been wound around the core no tensile force will be exerted on the conductors 42, 43, but only on the core 40.

It is to be noted that the invention is not limited to the embodiments shown in the Drawings. Various modifications to the embodiments described are possible without departing from the scope of the invention as defined in the claims. For example:

(a) the space for taking up the excess length of the first connecting means may be formed in the second unit,
(b) the second unit may contain the microphone (in which case the first connecting means establish an electrical connection between the microphone and the input of the amplifier,
(c) the second unit may accommodate both the loudspeaker and the microphone (in which case the first connecting means establish two electrical connections, namely between the amplifier and the loudspeaker and between the amplifier and the microphone),
(d) the hearing aid is constructed as a pair of hearing spectacles and the first unit is accommodated in the spectacle frame.

A hearing aid manufacturer may supply a hearing aid in accordance with the invention either in the fully assembled condition or in such condition that only the tubular element 15 or 15' has not yet been secured in the duct 16 or 16' (the electrical connection 14 has been made already), or as two separate parts, one part comprising a first unit 1 or 1' and the other part comprising the second unit 2, to which one end of the tubular element 15 or 15' and the first connecting means 14 have already been secured.

In the last mentioned case the retailer or audiologist has the freedom to combine a first unit of a specific type and a second unit of a specific type. The other end of the first connecting means 14 must then be fed through the duct 16 or 16' and secured to terminals on the p.c. board 5. Subsequently, the hearing aid can be adapted by shifting the tubular element 15 of 15' in the duct 16 or 16' and then securing the tubular element 15 or 15'.

In the last but one case the retailer or audiologist does not have the freedom to combine units and can only adapt the hearing aid by shifting and subsequently securing the tubular element 15 or 15' in the duct 16 or 16'.

What is claimed is:

1. A hearing aid, in particular a behind-the-ear hearing aid, comprising:

a first unit including an amplifier, a second unit comprising an electro-acoustic transducer and intended to be worn in the ear;

first connecting means for electrically coupling the electro-acoustic transducer to the amplifier, and second connecting means for mechanically intercoupling the two units, said second connecting means comprising a tubular element having a first end coupled to one of said first and second units, said tubular element accommodating the first connecting means, wherein a part of the other unit of said first and second units has a duct of a diameter larger than the outer diameter of the tubular element so that, in a first condition in which the tubular element is not secured relative to said part of the other unit, said tubular element is slidable in said duct over at least a part of its length and in the longitudinal direction of said duct, and in a second condition in which the tubular element is secured relative to said part of the other unit said tubular element extends into the duct over at least a part of its length, the first connecting means having a minimum length such that when the tubular element in the duct of said part of the other unit has been slid out of said duct to the maximum permissible extent, the first connecting means is sufficiently long for the first and second units to be electrically coupled to one another, and wherein at least one of the two units includes a space to accommodate any excess length of the first connecting means when the tubular element has been slid further into the duct in said part of the other unit.

2. A hearing-aid as claimed in claim 1, wherein the tubular element is made of a flexible material.

3. A hearing aid as claimed in claim 1, wherein said part of the other unit is also tubular.

4. A hearing aid as claimed in claim 3, wherein the space is provided with a spindle around which the first connecting means have been wound at least once.

5. A hearing aid as claimed in claim 4, wherein a spiral spring is arranged on said spindle, and said spiral spring having one end secured to a fixed part of the unit in which the space is formed and another end secured to the first connecting means.

6. A hearing aid as claimed in claim 1 wherein said space is formed in the first unit.

7. A hearing aid as claimed in claim 1 wherein in the second condition the tubular element is secured relative to said part of said other unit by means of an adhesive.

8. A hearing aid as claimed in claim 1 wherein in the second condition said tubular element is secured relative to said part of the other unit by clamping.

9. A hearing aid as claimed in claim 1, wherein the first unit comprises a hook that is intended to be worn behind the ear, characterized in that the first unit is said other unit and said part of the other unit is the hook of a behind-the-ear hearing aid.

10. A hearing aid as claimed in claim 2, wherein said part of the other unit is tubular.

11. A hearing aid as claimed in claim 1, further comprising a spindle located within said space, the first connecting means being wound around the spindle at least once.

12. A hearing aid comprising:

a first unit including a housing with an amplifier located therein, a second unit including an ear plug for insertion in the ear and having an electro-acoustic transducer located therein, electrical connecting means for interconnecting the transducer to the amplifier, mechanical coupling means for mechanically coupling the first and second units and including a tubular element having a first end coupled to one unit of said first and second units, the other unit of said first and second units having a duct in which the tubular element is adapted to slide in a longitudinal direction so that the overall length of the duct and tubular element together is adjustable, said electrical connecting means being adapted to pass through the duct and tubular element and having a minimum length so that upon adjustment of the tubular element to a maximum overall length the electrical connecting means is long enough to electrically interconnect the amplifier and transducer, and wherein at least one unit of said first and second units includes a space therein for storing any excess length of the electrical connecting means upon adjustment of the tubular element to a position less than said maximum overall length.

13. A hearing aid as claimed in claim 12 wherein: said one unit to which the first end of the tubular element is coupled comprises the second unit, the other unit comprises the first unit and said duct has a curved shape, and said tubular element is made of a flexible material.

14. A hearing aid as claimed in claim 13 further comprising a microphone located in said first unit, wherein said electrical connecting means includes plural wires and said space is formed in the housing of the first unit and includes a spindle around which the wires are wound at least once.

15. A unit adapted to cooperate with an other unit which together form a hearing aid which includes an amplifier and an electro-acoustic transducer, said unit comprising:

first connecting means adapted for electrically coupling the electro-acoustic transducer to the amplifier, an electric terminal electrically coupled to one end of the first connecting means, a tubular element having a first end coupled to the said unit, said tubular element accommodating at least a part of the first connecting means, said tubular element being adapted to slide within a duct of the other unit over at least a part of its length and in a longitudinal direction of said duct, and the first connecting means being of a length so as to permit electrical coupling between said units when the tubular element has been slid out of the said duct to the maximum permissible extent.

16. A unit as claimed in claim 15 which comprises a space for storing excess length of the first connecting means.

17. A unit as claimed in claim 15, characterized in that it includes the amplifier of the hearing aid.

18. A unit as claimed in claim 15, characterized in that it includes the electro-acoustic transducer of the hearing aid.

19. An other unit, adapted to cooperate with a unit having a tubular element, said unit and said other unit together forming a hearing aid which includes an amplifier and an electro-acoustic transducer; said unit comprising: first connecting means adapted for electrically coupling the electro-acoustic transducer to the amplifier, an electrical terminal electrically coupled to one end of the first connecting means, a tubular element having a first end coupled to the said unit, said tubular element accommodating at least a part of the first connecting means, said tubular element being adapted to slide within a duct of the other unit over at least a part of its length and in a longitudinal direction of said duct, and the first connecting means being of a length so as to permit electrical coupling between said units when the tubular element has been slid out of the said duct to the maximum permissible extent, said other unit comprising:

a duct having a diameter larger than the outer diameter of the tubular element of the unit and adapted to cooperate with the tubular element so that said tubular element can be slid in said duct over at least a part of its length and in the longitudinal direction of said duct, and an electrical terminal adapted to be electrically coupled to an end of the first connecting means of the unit.

20. An other unit as claimed in claim 19, characterized in that it comprises a space for storing an excess length of the first connecting means.

21. An other unit as claimed in claim 19, characterized in that it comprises the amplifier of the hearing aid.

22. An other unit as claimed in claim 19, characterized in that it comprises the electro-acoustic transducer of the hearing aid.

* * * * *